US010126711B2

(12) United States Patent
Winkler et al.

(10) Patent No.: US 10,126,711 B2
(45) Date of Patent: Nov. 13, 2018

(54) MECHANICAL WATCH WITH ISOCHRONIC POSITION INSENSITIVE ROTARY RESONATOR

(71) Applicant: ETA SA Manufacture Horlogere Suisse, Grenchen (CH)

(72) Inventors: Pascal Winkler, St-Blaise (CH); Jean-Luc Helfer, Le Landeron (CH); Gianni Di Domenico, Neuchatel (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 0 days.

(21) Appl. No.: 15/727,837

(22) Filed: Oct. 9, 2017

(65) Prior Publication Data

US 2018/0113420 A1 Apr. 26, 2018

(30) Foreign Application Priority Data

Oct. 25, 2016 (EP) ..... 16195399

(51) Int. Cl.
*G04B 17/04* (2006.01)
*G04B 17/32* (2006.01)

(52) U.S. Cl.
CPC ..... *G04B 17/04* (2013.01); *G04B 17/32* (2013.01)

(58) Field of Classification Search
CPC ..... G04B 17/04; G04B 17/32; G04B 17/06; G04B 17/20; G04B 17/22
See application file for complete search history.

(56) References Cited

U.S. PATENT DOCUMENTS 2,770,942 A * 11/1956 Favret ..... G04B 18/006 368/170
2,880,570 A * 4/1959 Favret ..... G04B 18/006 368/170

(Continued)

FOREIGN PATENT DOCUMENTS

| | | |
|---|---|---|
| EP | 3 095 011 | 11/2016 |
| FR | 630.831 | 12/1927 |
| WO | WO 2015/104692 A2 | 7/2015 |

OTHER PUBLICATIONS

European Search Report dated Apr. 28, 2017 in European Application 16195399.7, filed on Oct. 25, 2016 (with English Translation of Categories of cited documents).

*Primary Examiner* — Sean Kayes
(74) *Attorney, Agent, or Firm* — Oblon, McClelland, Maier & Neustadt, L.L.P.

(57) ABSTRACT

A timepiece resonator mechanism having a central wheel train fixed in rotation around an axis of an input wheel train subjected to a driving torque, arranged to turn continuously, and having a plurality of N inertial elements, each movable in relation to the central wheel train, and restored to the axis by elastic restoring device. The mechanism having device between all the inertial elements that are arranged to maintain all centers of mass of these inertial elements at the same distance from the axis at any time, and the elastic restoring device cause an elastic potential such as: $Vtot=(d\alpha_0/dt)^2\cdot\Sigma j(Mj\cdot Rj^2)$, where: Vtot is the elastic potential, Σj is the sum over the js of the quantity between parentheses, $(d\alpha_0/dt)$ is the speed of rotation to be imposed, Rj is the position of the center of mass G of the inertial element j of mass Mj.

24 Claims, 6 Drawing Sheets

(56) References Cited

U.S. PATENT DOCUMENTS

| | | | | |
|---|---|---|---|---|
| 3,316,708 | A * | 5/1967 | Waldburger | G04B 17/045 368/168 |
| 9,465,362 | B2 * | 10/2016 | Cusin | G04B 17/04 |
| 9,465,363 | B2 * | 10/2016 | Winkler | G04B 17/045 |
| 2015/0185700 | A1 * | 7/2015 | Kawauchiya | G04B 17/063 368/127 |
| 2016/0327909 | A1 | 11/2016 | Henein et al. | |
| 2016/0327910 | A1 | 11/2016 | Henein et al. | |
| 2017/0123380 | A1 * | 5/2017 | Winkler | G04C 3/08 |
| 2017/0255164 | A1 * | 9/2017 | Zaugg | G04B 17/063 |

* cited by examiner

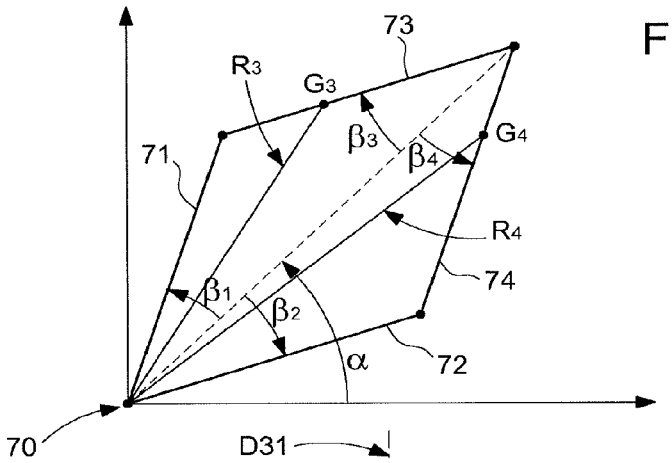
Fig. 7
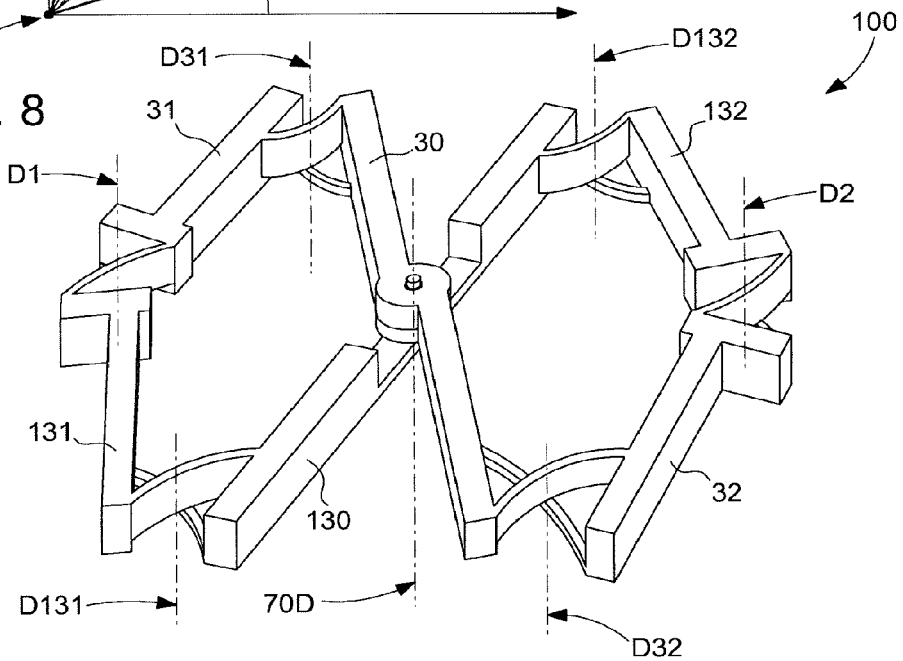
Fig. 8
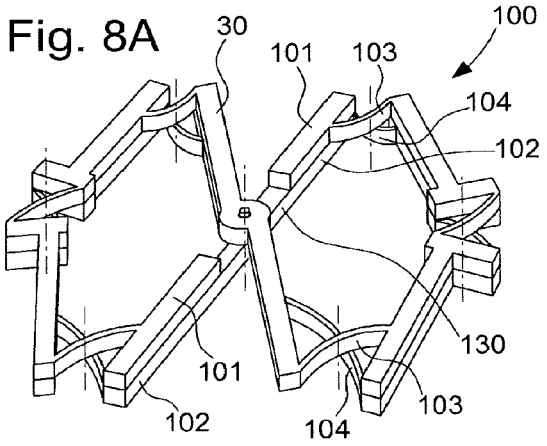
Fig. 8A
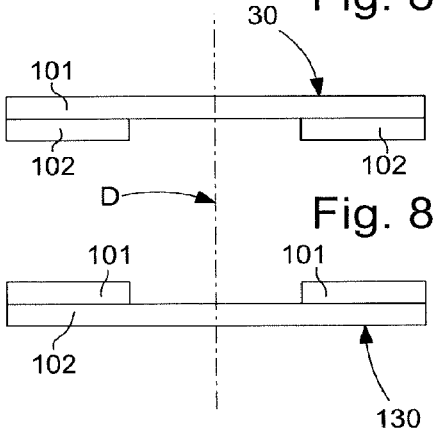
Fig. 8B
Fig. 8C

MECHANICAL WATCH WITH ISOCHRONIC POSITION INSENSITIVE ROTARY RESONATOR

This application claims priority from European patent application No. 16195399.7 filed on Oct. 25, 2016, the entire disclosure of which is hereby incorporated herein by reference.

FIELD OF THE INVENTION

The invention relates to a resonator mechanism for a timepiece movement having an input wheel train mounted to pivot around an axis of rotation and subjected to a driving torque, and having a central wheel train fixed in rotation to said input wheel train around said axis of rotation and arranged to turn continuously, wherein said resonator mechanism has a plurality of N inertial elements, each being movable according to at least one degree of freedom in relation to said central wheel train, and restored to said axis of rotation by elastic restoring means, which are arranged to cause a restoring effort on the centre of mass of said inertial element, wherein said resonator mechanism has a rotational symmetry of order N.

The invention also relates to a timepiece movement having at least one such resonator mechanism.

The invention also relates to a timepiece, in particular a watch, having such a timepiece movement.

The invention relates to the field of clockmaking resonator mechanisms forming time bases.

BACKGROUND OF THE INVENTION

The majority of current mechanical watches are fitted with a spring balance and a Swiss anchor escapement mechanism. The spring balance forms the time base of the watch. This is also called a resonator.

The escapement itself performs two main functions:

maintaining the reciprocating movements of the resonator;

counting these reciprocating movements.

In addition to these two main functions the escapement must be robust, impact-resistant and prevent jamming of the movement (overbanking).

The Swiss anchor escapement mechanism has a low energy efficiency (about 30%). This low efficiency results from the fact that the movements of the escapement are intermittent, that there are drops or backlashes to adapt to machining errors, and also from the fact that several components transmit their movement via inclined planes that run up against one another.

An inertial element, a guide arrangement and an elastic restoring element are needed to form a mechanical resonator. Traditionally, a spiral spring plays the role of elastic restoring element for the inertial element belonging to a balance. This balance is rotatably guided by pivots, which turn in smooth ruby bearings. This causes friction and therefore energy losses and disruptions to operation, which depend on positions and which one seeks to remove. The losses are characterised by the quality factor Q. The aim is to maximise this factor Q.

Patent application EP2847547 in the name of Montres BREGUET describes a mechanism for regulating the pivoting rate around a first pivot axis of a wheel train, in particular a striking mechanism, having an inertia block that pivots around a second pivot axis parallel to the first. The regulator has means for restoring the inertia block towards the first axis. When the wheel train pivots at a rate below a reference rate, the inertia block remains confined in a first revolution space around the first axis. When this wheel train pivots at a rate above the reference rate, the inertia block enters a second revolution space around the first axis, which is adjacent to and outside the first revolution space, and a peripheral portion of the inertia block cooperates in this second revolution space with regulation means arranged to cause the braking of the wheel train and bring its pivoting rate back to the reference rate, and to dissipate the excess energy. In particular, the wheel train is subjected to a braking torque by Foucault currents.

Patent application EP14184155 in the name of ETA Manufacture Horlogère Suisse describes a clockmaking regulator mechanism having the following that are movably mounted at least to pivot in relation to a plate: an escape wheel arranged to receive a driving torque via a train and a first oscillator having a first rigid structure connected to the plate by first elastic restoring means. This regulator mechanism has a second oscillator having a second rigid structure connected to the first rigid structure by second elastic restoring means, and that has guide means arranged to cooperate with complementary guide means belonging to the escape wheel that synchronise the first oscillator and the second oscillator with the train.

Patent application EP15153657 in the name of ETA Manufacture Horlogère Suisse describes a clockmaking oscillator having a structure and separate primary resonators, which are temporally and geometrically out of phase, each having a mass restored towards the structure by an elastic restoring means. This clockmaking oscillator has coupling means for interaction of the primary resonators that have driving means to cause a wheel train to move that has drive and guide means arranged to drive and guide a control means articulated to transmission means that are each articulated at a distance from the control means with a mass of a primary resonator, and the primary resonators and the wheel train are arranged so that the articulation axes of any two of the primary resonators and the articulation axis of the control means are never coplanar.

Patent application PCT/EP2015/065434 in the name of The Swatch Group Research & Development Ltd describes a clockmaking assembly having a combined resonator with improved isochronism to at least two degrees of freedom, which has a first linear or rotary oscillator of reduced amplitude in a first direction, in relation to which a second linear or rotary oscillator of reduced amplitude in a second direction substantially orthogonal to the first direction oscillates, this second oscillator comprises a second support mass of a sliding block. This clockmaking assembly has a wheel train arranged for the application of a torque of the resonator, wherein this wheel train has a groove, into which the sliding block slides with minimum play. This sliding block is arranged to at least either follow the curve of the groove when it has one or frictionally rub in the groove, or push back the inside lateral surfaces belonging to the groove by magnetised or electrified surfaces belonging to the sliding block.

Document FR630831A in the name of Schieferstein describes a process and a device for the transmission of power between mechanical systems or for the control of mechanical systems where two oscillating movements of flexible mechanisms forming an appropriate angle between them act on one another, so that an oscillation is produced that takes place along a closed curve and which in the aim of force transmission or of control is loosely coupled in accordance with a rotational movement. The restoring means are attached to the plate. The connecting element between the masses are elastic and consequently do not constitute kinematic linkages.

Document EP3095011A2 and document WO2015/104962 in the name of EPFL describe a mechanical isotropic harmonic oscillator comprising at least one two degrees of freedom linkage supporting an orbiting mass with respect to a fixed base with springs having isotropic and linear restoring properties. More specifically, a plane spring stage forms a two degree of freedom linkage actuating a purely translational movement of the orbiting mass so that the mass is displaced along its orbit while maintaining a fixed orientation. In a variant each spring stage comprises at least two parallel springs. The springs or other associated restoring means are again attached to the plate here.

When a mass guided to rotate around a fixed axis and connected to this axis by a radial linear restoring spring is driven to rotate by a grooved wheel, if a pin running in this groove is fixed to the mass and if this mass is point-form, its trajectories are ellipses or circles and are all isochronic. If the mass has a rotational inertia, then only the circular trajectories are isochronic. Particular conditions that are quite difficult to fine tune can allow the trajectories on circles to be stabilised, the resonator will then remain isochronic as a function of the driving torque of the wheel.

SUMMARY OF THE INVENTION

The present invention proposes to achieve two objects, i.e.:

- to eliminate the disturbances due to the friction of the pivots of the resonator to increase its quality factor;
- to eliminate the jolts of the escapement in order to increase the efficiency of the mechanism and in particular the efficiency of the function of holding and counting customarily assigned to an escapement mechanism.

To achieve these objects the invention proposes a rotary resonator mechanism according to claim 1.

Historically, clockmakers did not regard rotary resonators as time bases for watches, since they are not generally isochronic and are sensitive to gravity.

A rotary resonator mechanism according to the invention is also described in particular to include guide arrangements, in which the friction of guidance does not dissipate energy in stationary mode, thus improving the quality factor.

Moreover, in this particular rotary resonator mechanism the maintaining of rotation is performed by a torque applied directly to a shaft of the resonator, thus avoiding the dynamic losses of a classic anchor escapement To obtain a rotary resonator mechanism that can be used as time base for a timekeeping instrument, the invention endeavours to meet the main conditions:

- condition of isochronism: the rotary resonator mechanism has a plurality of movable inertial elements, each of which is restored towards a main axis of rotation by elastic restoring means, the elastic restoring effort of which causes on the centre of mass of this inertial element a central force that is proportionate in intensity to the distance between the axis of rotation and this centre of mass;
- condition of position insensitivity: the use of a plurality of movable inertial elements, each of which guided so as to be able to move away from the axis of rotation, in combination with:
- either an elevated frequency, i.e. higher than 20 Hz, in the case of an application to a watch;
- or a connection mechanism arranged to force the total centre of mass (of all these inertial elements) to remain on the axis of rotation irrespective of the amplitude, i.e. a kinematic linkage that forces the centres of mass of the different inertial elements to be on the same radius in relation to the axis of rotation at every moment;
- condition of shock and interference insensitivity: radial friction enabling the centres of mass of the inertial elements to be brought on a circular trajectory following a trajectory disturbance. This radial friction can be caused by air friction, friction of a pivot, a slide or similar.

The invention also relates to a timepiece movement having at least one such resonator mechanism.

The invention also relates to a timepiece, in particular a watch, having one such timepiece movement.

BRIEF DESCRIPTION OF THE DRAWINGS

Other characteristics and advantages of the invention will become clearer on reading the following detailed description with reference to the attached drawings, wherein:

FIG. 7 is similar to FIG. 6 and concerns the particular case of a regular isosceles rhombus half-pantograph, wherein all the arms between articulations are of equal length;

FIG. 8 is a schematic perspective view of another variant with a structure close to those of FIGS. 3 and 4 without pivot articulation except at the level of the axis of rotation, wherein the arms forming the segments of the pantograph form the inertial elements and where the linkages between these arms have flexible guide means with projecting crossed blades;

FIG. 8A shows an advantageous variant in a similar view to FIG. 8 comprising, in superposed arrangement, a single-piece upper structure, which comprises all the upper blades, and a single-piece lower structure, which comprises all the lower blades; FIGS. 8B and 8C are side views of the central wheel train and the secondary central wheel train of this pantograph;

DETAILED DESCRIPTION OF PREFERRED EMBODIMENTS

The invention relates to a resonator mechanism 100 provided for a timepiece movement 200 primarily intended to be integrated into a watch 300. In fact, the resonator mechanism 100 according to the invention is designed to be isochronic, insensitive to positions in the gravitation field and, if not insensitive to shocks and interference, is at least arranged to resume its normal operation very quickly.

This resonator mechanism 100 is a rotary resonator. It has the special feature of having no standard escapement mechanism and of operating continuously. The absence of jolts enables the energy efficiency to be substantially improved in comparison to a classic resonator of the type comprising a spring balance coupled to an anchor escapement.

Figure 1:
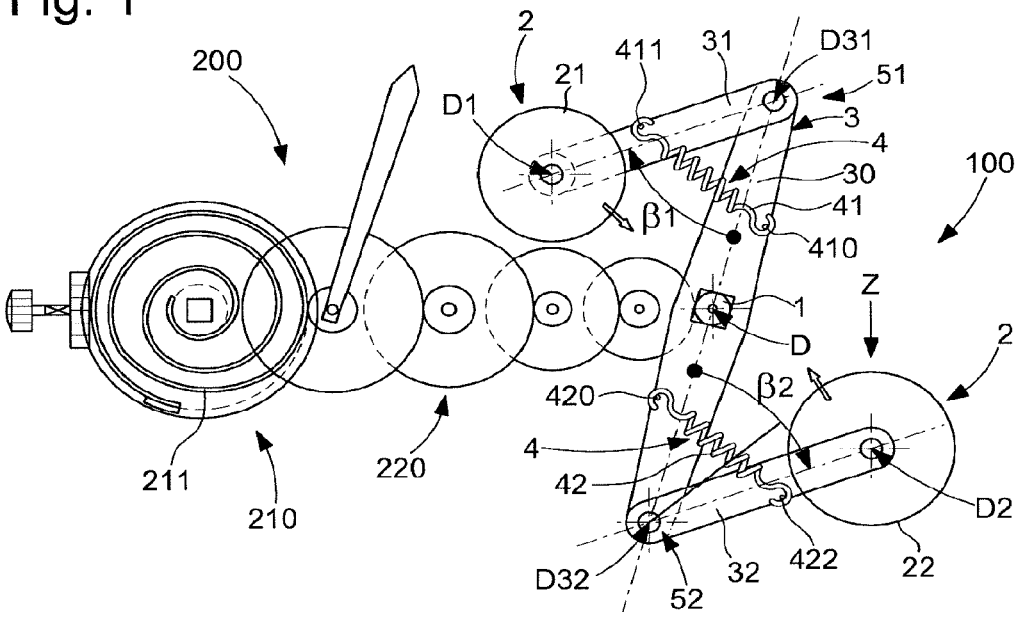
FIG. 1 is a schematic plan view of a mechanical timepiece movement having a barrel driving a going train, which drives an input wheel train of a continuous rotary regulator mechanism according to the invention in an articulated variant having two inertial elements carried by arms mounted to pivot in relation to a common structure turning around the axis of rotation of a input wheel train, wherein each arm is restored towards this axis by particular elastic restoring means.

This resonator mechanism 100 has an input wheel train 1 mounted to pivot around an axis of rotation D. This input wheel train 1 is subjected to a driving torque. FIG. 1 illustrates a classic configuration of a timepiece movement 200, which comprises means for accumulating and storing energy 210, here comprising in a non-restrictive manner a barrel 211, arranged to classically drive a wheel train 220, in particular a going train, of which the element furthest downstream drives the input wheel train 1 thus subjected to the torque of the going train.

According to the invention the resonator mechanism 100 comprises a common structure, which is deformable or articulated and which is rotatably fixed to the input wheel train 1 around the axis of rotation D. This common structure bears or comprises a plurality of N inertial elements 2. This common structure also turns continuously. There is no reciprocating movement: once subjected to a driving torque, the common structure turns in a single direction of rotation. This does not prevent the structure from being reversible and capable of turning in the other direction if it is subjected to a torque from the opposite direction.

Each inertial element 2 is guided to at least one degree of freedom in relation to the common structure.

Each inertial element 2 is restored towards the axis of rotation D by elastic restoring means 4, which are arranged to cause a restoring effort on the centre of mass of this inertial element 2.

According to the invention these elastic restoring means 4 are installed in the rotary resonator mechanism 100.

This restoring effort is directed towards the axis of rotation D and has an intensity proportionate to the distance $R_G$ between the axis of rotation D and the centre of mass of the inertial element 2 in question.

In a particular variant the same elastic restoring means 4 are common to several inertial elements and in particular can consist of a draw spring joining the trunnions arranged on the inertial masses or similar.

In another variant illustrated in particular in FIGS. 1, 2, 12, 13, 14 where the resonator mechanism 100 is articulated, such elastic restoring means 4 are arranged between the common structure, on the one hand, and an inertial mass 2 or a support arm 31, 32 of an inertial mass 2, on the other.

Figure 15:
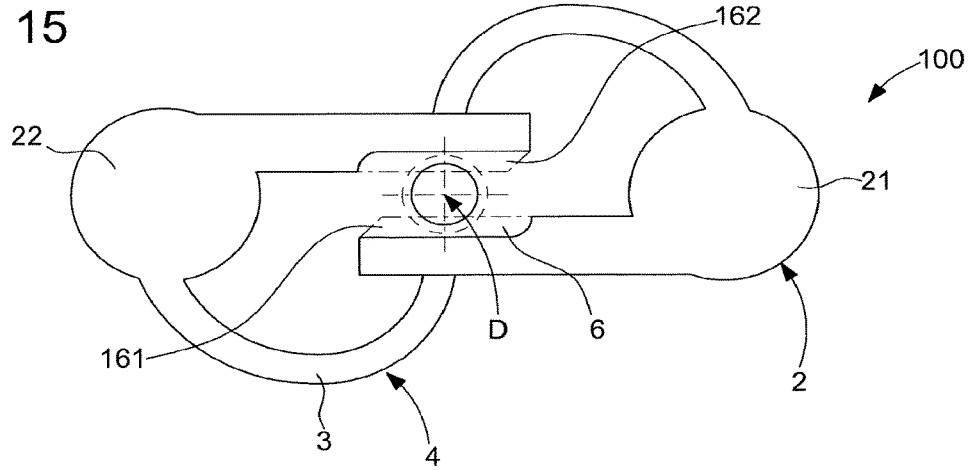
FIG. 15 is a schematic plan view of a variant where the kinematic linkage is flexible, wherein the common structure is a flexible blade that carries the inertial elements, which each bear a support arm of a rack element cooperating with an axial idle wheel.
Figure 17:
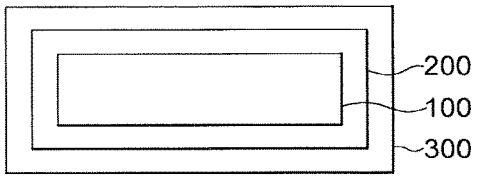
FIG. 17 is a block diagram showing a watch having a movement, which itself comprises a continuous rotary regulator mechanism according to the invention.

In a further variant, as evident in FIG. 15, the common structure is elastically deformable and constitutes such elastic restoring means 4.

The resonator mechanism 100 has a rotational symmetry of order N, wherein N is the number of inertial masses 2. This is not the case in the prior art cited above.

In a variant where the resonator mechanism 100 is articulated, each inertial element 2 is guided directly or indirectly by arms or secondary articulated systems in relation to the common structure by at least one guide means 5.

FIG. 1 thus shows an example where the common structure comprises a central wheel train 30, which at its two ends bears pivots 51, 52 for articulation around axes D31 and D32 and which respectively bear arms 31, 32 that themselves bear inertial elements 2: 21 and 22, which depending on the practical variant can be either mounted loosely on these arms 31, 32 at the level of axes D1, D2 passing through their centre of mass, or fixedly mounted in relation to these arms.

In this variant of FIG. 1 the elastic restoring means 4 are in rotation and separated: 41 and 42, arranged, on the one hand, between the central wheel train 30 of the common structure 3 at the level of an inside attachment 410, 420 and, on the other hand, the arm 31, 32 at the level of an outside attachment 411, 421.

Figure 12:
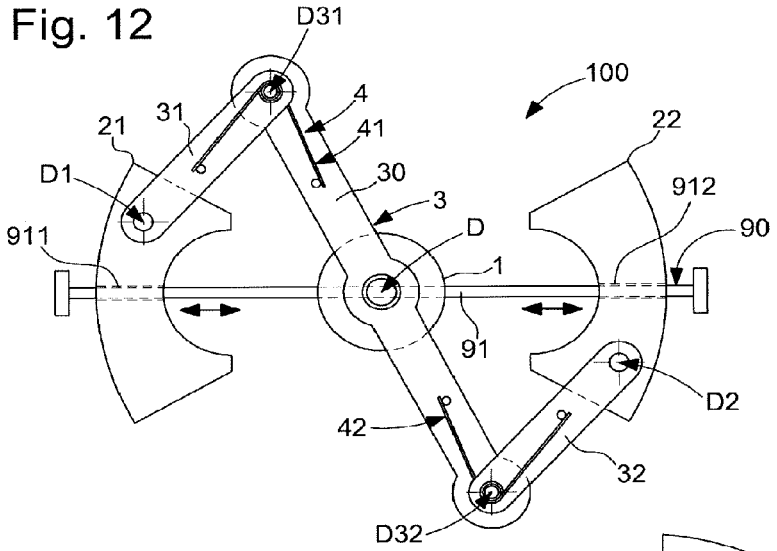
FIG. 12 is a schematic plan view of another variant of kinematic linkage with radial linear guidance with a radial guide bar sliding in bores of the inertial elements, wherein the elastic restoring means of the inertial elements are formed by V-shaped springs.

It is understood that each inertial element 2 can have a degree of freedom in rotation, as on the majority of the present figures, or a degree of freedom in translation, as in FIG. 12.

In the variant where each inertial element 2 has a degree of freedom in rotation, more specifically the elastic restoring means 4 cause an elastic potential comparable to a total elastic energy potential characterised by the following equation:

$$Vtot=\frac{1}{2}\cdot\omega_0^2\cdot\Sigma j(Mj\cdot R^2j(\beta i)),$$

wherein:

Vtot is the elastic potential that represents an elastic energy,

Σj is the sum over the js of the quantity between parentheses, $\omega_0$ is the rotation speed that is to be imposed, Rj(βi) is the position of the centre of mass of the inertial element j as a function of the value of the degree of freedom βi, Mj is the mass of the inertial element j.

More particularly Rj(βi) has an only value Rj, and the restoring means cause an elastic potential characterised by the following equation:

$$V=\frac{1}{2}\cdot(d\alpha_0/dt)^2\cdot\Sigma(MjRj^2)$$

where:

V is the elastic potential

Σj is the sum of the quantity between parentheses $(d\alpha_0/dt)$ is the speed of rotation to be imposed Rj is the distance of the axis of rotation from the centre of mass G of said inertial element (2)

Mj is the mass of said inertial element.

It is understood that in the articulated example of FIG. 1 comprising two inertial elements 21 and 22 the resonator mechanism 100 according to the invention must navigate three angles at any time: that of the common structure 3 with a plate of the timepiece movement or similar and those, β1 and β2, that the centres of mass of the inertial elements 21 and 22 form in relation to the common structure 3, with reference to the axes D31 and D32 of the respective guide arrangements 51 and 52. Of course, it is a matter of navigating N1+ angles in the case of N inertial elements.

The system is self-regulated: under the effect of the torque transmitted by the driving means of the movement each inertial element tends to move away from the axis of rotation D to a radial position where the friction of the air transmits a resisting torque, which in a tangential direction balances the effect of the torque applied to the input wheel train 1 related to the centre of mass of the inertial element. In the radial direction it is the centrifugal force that balances the radial component of the restoring effort transmitted by the elastic restoring means 4. This tangential and radial dual balance determines the radial position of the centre of mass at any time as a function of the instantaneous value of the torque emitted by the driving means. The angular speed of rotation is equal to the square root of the quotient of the rigidity of the elastic restoring means by the mass of the inertial element, whereas the instantaneous radius of the centre of mass in relation to the axis of rotation D is equal to the square root of the quotient between the driving torque and the product of the angular speed and the coefficient of friction between the surrounding environment and the inertial element.

The centres of mass of the inertial elements tend to reach the axis of rotation D when the driving means are at a halt, wherein this position corresponds to the exertion of a zero traction effort on the part of the elastic restoring means 4. It can be easier to form a resonator mechanism 100 wherein the inertial masses 2 approach the axis of rotation, particularly if these inertial masses 2 are in the same plane, and come into contact with one another, for example, in a resting position, and the elastic restoring means 4 are then assembled with a prestress.

The disturbance due to the gravitation field tends to differentiate the behaviour of the inertial elements in certain positions of the watch 300. For example, FIG. 1 has a reference Z in the plane of the sheet and directed towards the bottom of the sheet, which indicates the vertical of the location and the gravitation field, the inertial element 22 tends to move away from the common structure 3, whereas the inertial element 21 tends to approach it. If the inertial elements 2 are radially completely free, it may also be the case that they are located on different radii in relation to the axis of rotation D.

To avoid this effect of the gravitation field it is therefore advantageous to perform a movement transfer reducing the number of degrees of freedom of each inertial element 2 and to establish a mechanical coupling that forces the radial position in relation to the axis of rotation D of each inertial element 2 in relation to the others. Thus, the overall centre of mass of the entire resonator mechanism can rest on the axis of rotation D. A symmetry in relation to the axis of rotation D is preferably established.

For this, the rotary resonator mechanism 100 advantageously comprises a kinematic linkage, and more particularly a rigid kinematic linkage, between at least two inertial elements 2, and preferably between all the inertial elements 2. This linkage forces the inertial elements 2 to be continuously located at the same distance from the axis of rotation D. This means that the inertial elements 2 no longer have a degree of freedom in relation to the common structure 3.

This kinematic linkage is suitable for low frequencies, 2 to 5 Hz in particular. On the other hand, if the speed of rotation of the common structure 3 is raised, in particular corresponding to a period higher than or equal to 20 Hz, for example, in the order of 50 Hz, the effect of the gravitation field is negligible in the face of the effects of inertia, and such a kinematic linkage is not essential. Such a very simple configuration can be suitable for single use applications such as fireworks or similar. The kinematic linkage becomes necessary, however, as soon as good chronometric performance rates are sought, in particular for use in a watch.

Different examples of such kinematic linkages are illustrated in FIGS. 2, 3, 4, 8, 9, 10, 12, 13, 14, 15 and 16 and will be explained below. The majority are articulated rigid kinematic linkages and some illustrate flexible kinematic linkages.

Figure 2:
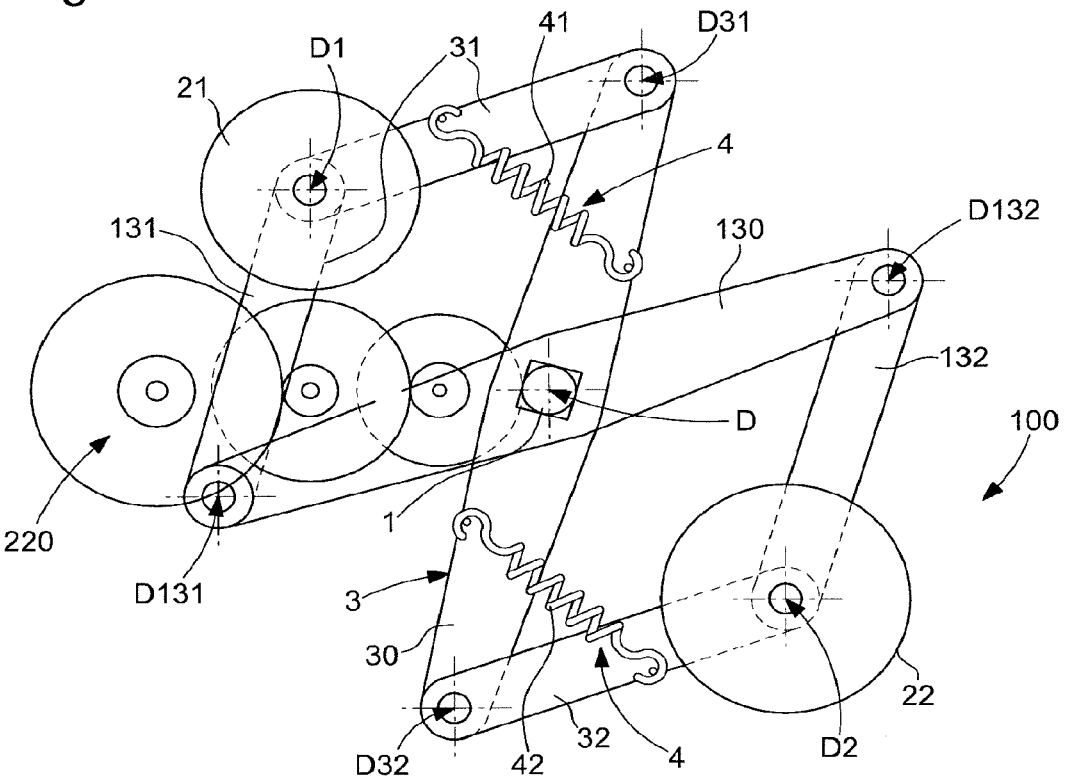
FIG. 2 in a similar manner to FIG. 1 shows a mechanism derived from that of FIG. 1 having means for maintaining the centres of mass of the inertial elements at the same distance from the axis of rotation at any time in order to render the continuous rotary regulator mechanism insensitive to the effects of the gravitation field, these means consisting of an articulated pantograph.

FIG. 2 shows an advantageous configuration of the invention in an unfolded position where the kinematic linkage is formed by way of a pantograph structure: the resonator mechanism 100 has a pantograph structure articulated in symmetry around the axis of rotation D having at least all the inertial elements 2 articulated either directly or indirectly by means of arms, which in accordance with the variants are given the references 31, 32, 131, 132, 121, 122, 123, 124, around the central wheel train 30 and a secondary central wheel train 130, which is arranged to pivot around the axis of rotation D and which together with the central wheel train 30 constitutes a crossed structure. "Arm" is understood here to mean a component having two articulations.

"Pantograph" refers to a double structure articulated around a central axis and the double rhombus shape is illustrated more particularly in the figures. "Half-pantograph" refers to the part of the structure located on a single side of the central axis. The pantograph has two half-pantographs having common elements that form a crossed structure.

More specifically, this crossed structure formed by the central wheel train 30 and the secondary central wheel train 130 has its centre of mass on the axis of rotation D.

Thus, in FIG. 2, the kinematic linkage and the guide arrangements are configured by combining, on the basis of the example in FIG. 1: a central wheel train 30, a secondary central wheel train 130 pivoting around the axis of rotation D at the level of an axial pivot, the two arms 31 and 32 pivoted on the central wheel train 30, two other secondary arms 131 and 132 pivoted loosely at the same time on the secondary central wheel train 130 around axes D131 and D132 at the level of pivots (not shown in detail) and on the inertial elements 21 and 22 at the level of axes D1 and D1, and the seven articulations necessary for its operation in order to form a pantograph having a symmetry of rotation of order 2.

In a particular variant the secondary central wheel train 130 pivots loosely around the axis of rotation D.

The elastic restoring means 41 and 42 are the same as in FIG. 1, since the rod assembly formed by the two arms 131 and 132 around the secondary central wheel train 130 is passive, its only function being to maintain the centres of mass of the inertial elements 21 and 22 in symmetry in relation to the axis of rotation D.

Figure 3:
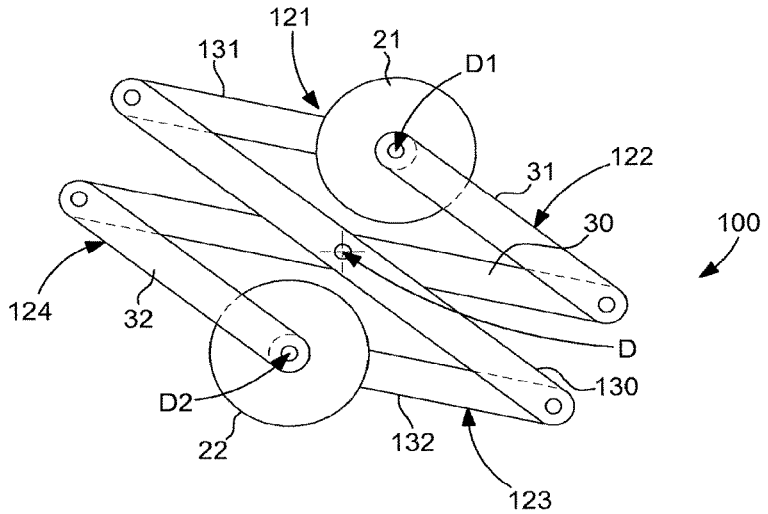
FIG. 3 is a variant of the mechanism of FIG. 2 wherein the inertial elements are combined with adjacent arms of the pantograph.
Figure 4:
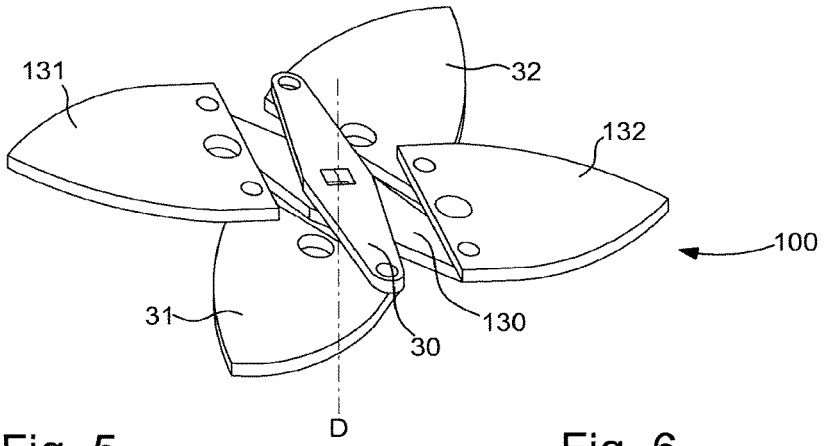
FIG. 4 is a variant of the mechanism of FIG. 3, wherein the arms are all replaced by inertial elements articulated on a central wheel train driven by the going train and a secondary central wheel train together forming a cross at the heart of the pantograph.

Naturally, as evident in the variants illustrated in FIGS. 3 and 4, some arms can form the inertial elements. The variant of FIG. 3, which is very close to that of FIG. 2, illustrated in a folded position, combines the inertial element 21 and the secondary arm 131 to form an inertial element 121 and combines the inertial element 22 and the secondary arm 132 to form an inertial element 123, arm 31 forming an inertial element 122 and arm 32 forming an inertial element 124.

More specifically, all the inertial elements 2 are articulated directly on the central wheel train 30 and the secondary central wheel train 130. Thus, the very compact variant of FIG. 4 comprises four inertial elements, which thus form arms 31, 32, 131, 132 articulated in pantograph form around the central wheel train 30 and the secondary central wheel train 130.

Figure 5:
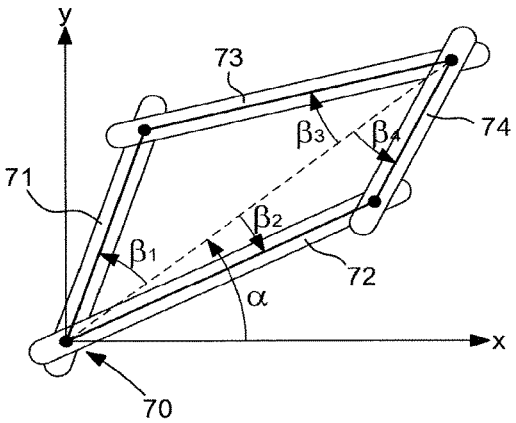
FIG. 5 is a diagram of a rhombus-shaped half-pantograph with sides of any dimensions.
Figure 6:
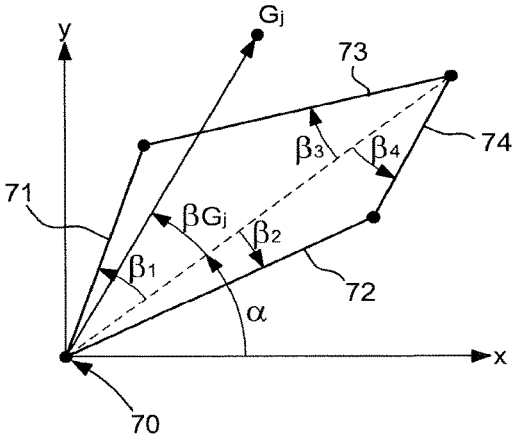
FIG. 6 is a diagram of the same half-pantograph showing the polar coordinates of the centre of mass of a segment j.

FIGS. 5 and 6 are diagrams of the half-pantograph with the polar coordinates of the centre of mass of a segment j in FIG. 6. "Segment" here is the geometric definition of a side of the rhombus of the half-pantograph and "arm" denotes the physical component incorporated in the mechanism.

FIG. 7 illustrates the particular case of a isosceles and regular rhombus half-pantograph, where:

$$\beta_1=\beta_2=\beta_3=B_4,$$

with the centres of mass G2 and G4 of segments 73 and 74 located on the straight line that joins the joints on either side of the segment concerned, A13 to A34 and A24 to A34 respectively.

In the case of any half-pantograph, as evident in FIGS. 5 and 6, each member in four-sided form of the pantograph comprises four segments 71, 72, 73, 74 articulated to one another and in relation to a pivot axis formed by a main joint 70 or the axis of rotation D. The central wheel train 30 is formed from two first segments 71 in the extension of one another in relation to the main joint 70, and the secondary central wheel train 130 is formed from two second segments 72 in the extension of one another in relation to the main joint 70. The elastic restoring means 4 generate a potential energy V, which is dependent on the angle of deformation $\beta_1$ of the pantograph member in accordance with equation:

$$\partial V(\beta_1)/\partial\beta_1=\tfrac{1}{2}(d\alpha_0/dt)^2\cdot\Sigma j(Mj\cdot Rj(\beta_1)\cdot R'j(\beta_1)),$$

(this condition enabling the isochronism of any pantograph to be guaranteed)

where:

$V(\beta_1)$ is the potential as a function of angle $\beta_1$, $\beta_1$ is the opening angle of the pantograph, i.e. the angle between, on the one hand, the straight line that joins the point of the pantograph opposite the pivot axis to the pivot axis and, on the other hand, the segment in question, $\omega_0=d\alpha_0/dt$ is the speed of rotation of the rotary resonator mechanism 100, $\Sigma j$ is the sum over the js of the quantity between parentheses, Mj is the mass of the inertial element 2 of row j $Rj(\beta_1)$ is the distance of the axis of rotation to the centre of mass Gj of the inertial element 2 of row j, $R'j(\beta_1)$ is the derivative of the distance between the pivot axis and the centre of mass of the inertial element 2 of row j in relation to $\beta_1$.

More specifically, the centre of mass of each arm (31; 32; 131; 132; 121, 122, 123, 124), which is contained between two articulations, is located on a straight line joining the two articulations on either side of the arm in question.

More specifically and particularly in the variant of FIGS. 4 and 7, each member of the half-pantograph comprises four segments of equal length L and together form a regular rhombus. The centre of mass of the central wheel train 30 and that of the secondary central wheel train 130 are located on the axis of rotation D of the resonator mechanism 100 and the centres of mass of each of the inertial arms are located on a line defined by the two articulations of the corresponding arm.

More specifically, with reference to the notations of FIG. 7, the potential energy $V_{tot}$ of the elastic restoring means is linked to their angle of deformation by the equation:

$$V_{tot}(\beta 1)=L(M_3\cdot R_3+M_4\cdot R_4)\cdot(d\alpha_0/dt)^2\cdot\cos 2\beta 1$$

where:

$\beta_1$ is the opening angle of the pantograph,

L is the length of each segment between the articulations, $M_3$ is the mass of a third segment 73 forming one of the two inertial elements opposite the pivot axis formed by a main joint 70 or by the axis of rotation D and contained between a first lateral joint A13 and an apex joint A34 opposite an axis joint A12 forming the main joint 70, $M_4$ is the mass of a fourth segment 74 forming the other of the two inertial elements opposite said pivot axis and contained between a second lateral joint A24 and the apex joint A34, $R_3$ is the distance of the first lateral joint A13 from the centre of mass G3 of the third segment 73, $R_4$ is the distance of the second lateral joint A24 from the centre of mass G4 of the fourth segment 74, $d\alpha_0/dt$ is the speed of rotation of the rotary resonator.

Such a pantograph type of structure combined with adequate elastic restoring means thus forms a mechanism, which theoretically speaking enables the constancy of the rotation period of the input wheel train 1 to be guaranteed and the position insensitivity in the gravitation field to be assured.

Practical realisation nevertheless requires precautions during execution because of the large number of articulation guide arrangements, synonymous with friction and loss of efficiency.

Other types of kinematic linkage will be outlined below.

To avoid the cost of an articulated system associated with machining precision and the parallelism of the axes and the change in efficiency as a result of friction at the pivots, a particular embodiment of the invention relates to a mechanism, in which at least one of the guide elements and at least one of the elastic restoring means 4 are joined together by a flexible guide means. This means that the distinct functions of guidance and elasticity are performed by a single flexible guide means. More specifically, except for the guide arrangements at the level of the axis of rotation, all the rotational guide arrangements and elastic restoring means are configured by flexible guide means.

More specifically, at least one such flexible guide means has at least two blades contained in planes and together define a virtual axis of rotation of a flexible rotary guide arrangement.

More specifically, in a pantograph type structure such as that described above, at least four of its articulations are formed by flexible rotary guide arrangements.

FIG. 8 thus shows a structure close to those of FIGS. 3 and 4 without pivot articulation, except at the level of the axis of rotation D, in which the arms 31, 131, 32, 132 forming the segments of the pantograph form the inertial elements. In this non-restrictive variant the flexible guide means each have two blades arranged at parallel and separate levels and cross at the level of the articulation axes D31, D1, D131, D132, D2 and D32 in projection on a parallel plane.

A simple configuration is illustrated in FIGS. 8A, 8B and 8C and consists of an upper single-piece structure 101, which comprises all the upper blades 103, and a lower single-piece structure 102, which comprises all the lower blades 102, being superposed. These upper 101 and lower 102 structures can be assembled together very simply by gluing, riveting or other means, and the radial positions of the different articulations as well as the symmetry of the inertial elements in relation to the axis of rotation D are perfectly guaranteed.

More specifically, these flexible rotary guide arrangements between two components are such arrangements with projecting crossed blades, as outlined above, the opening angle of which θ, read on the projection plane between the intersection axis C and the anchorage points of the blades on one of the components, has a value of 40°+/−4°, and the blades cross at a proportion of length of 0.15+/−0.015. This crossing can be performed just as well close to the most mobile component, i.e. the one with the most significant displacement, as close to the least mobile component, and it is generally determined by the dimensioning of the components to ensure the required distance between the anchorage points of the blades.

More specifically, the flexible guide means are made from oxidised silicon to compensate thermal effects.

FIGS. 9 to 16 show several variants that enable the radial symmetry of movement of the centres of mass of the inertial elements to be guaranteed, where appropriate, on the basis of articulated rigid kinematic linkages or also flexible kinematic linkages.

Figure 9:
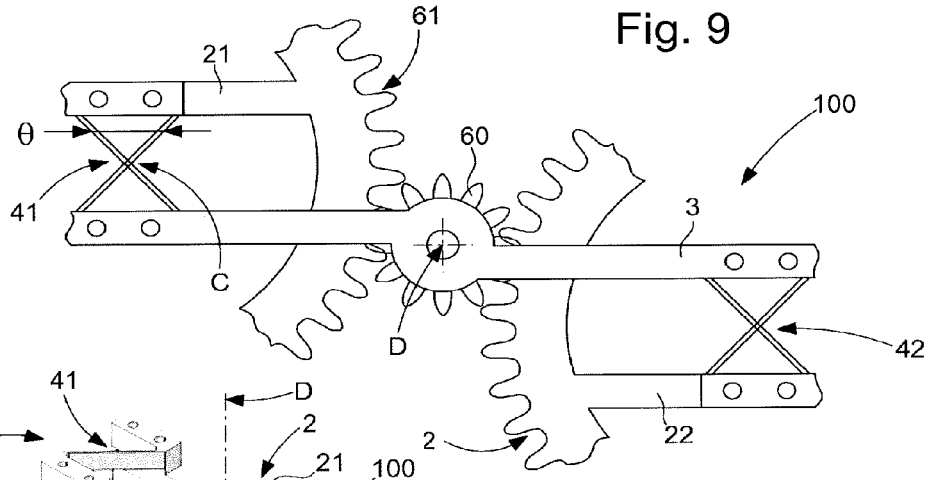
FIGS. 9 and 10 respectively show a schematic plan view and a schematic perspective view of a variant of a rigid kinematic linkage between two inertial elements having an axial idle toothed wheel, which continuously cooperates with two toothed sectors integral to the inertial elements, which are articulated on the common structure by flexible guide means with projecting crossed blades.
Figure 10:
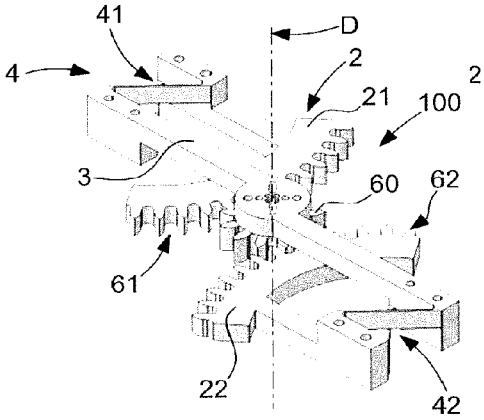
Figure 11:
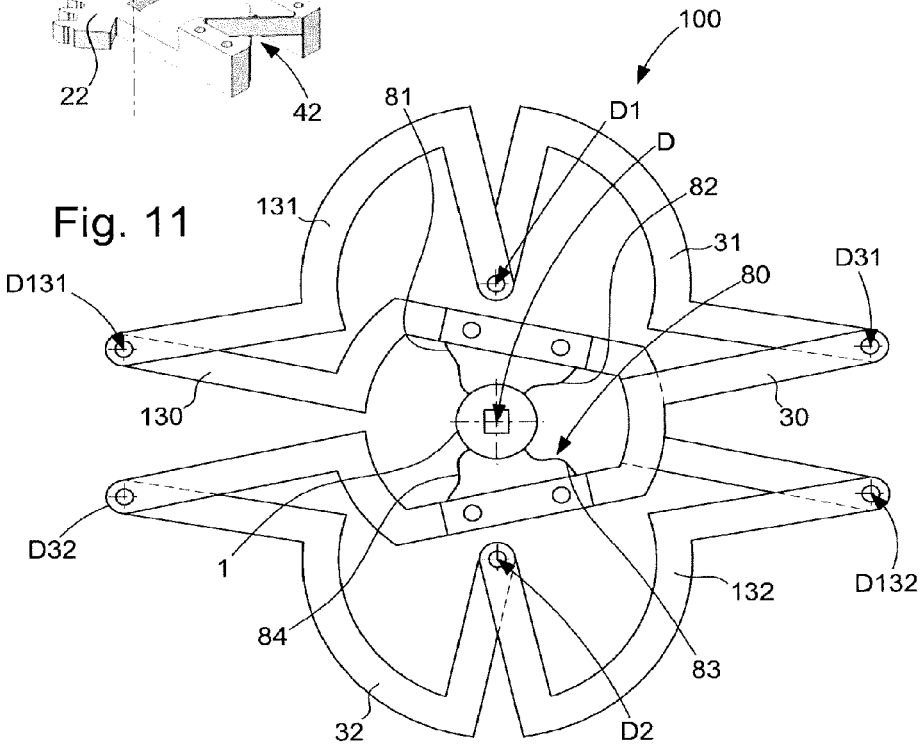
FIG. 11 is a schematic plan view of a variant pantograph, the central wheel train of which is fixed to the input wheel train by an elastic connection and the secondary central wheel train is fixed to the input wheel train by another elastic connection.

To establish the rigid kinematic linkage between the inertial elements 2 (21 and 22) the configuration of FIGS. 9 and 10 comprises? is formed by means of a toothed wheel 60 mounted loosely concentrically to the axis of rotation D and which continuously cooperates with two toothed sectors 61 and 62 integral to the inertial elements 21 and 22. Here the latter are shown articulated on the common structure 3 by such flexible guide means with projecting crossed blades 41 and 42.

In a particular variant of the pantograph type structure having a central wheel train 30 and a secondary central wheel train 130, the central wheel train 30 is fixed to the input wheel train 1 by an elastic connection 80 and the secondary central wheel train 130 pivots around the axis of rotation D, but this pivoting movement is limited by an elastic connection 70 joining it to the input wheel train 1. In this particular variant illustrated by FIG. 11 the central wheel train 30 and the secondary central wheel train 130 are each subjected to a driving torque equivalent to half the equivalent escapement torque in a classic escapement mechanism.

More specifically, this elastic connection 80 is a flexible rotary guide arrangement having two elastic blades.

FIG. 12 shows another variant, in which the kinematic linkage has radial linear guide means 90 with a radial guide bar 91 sliding in the bores 911 and 912 of the inertial elements 21 and 22. The elastic restoring means 4 here are formed each time by a V-shaped spring 41, 42.

Figure 13:
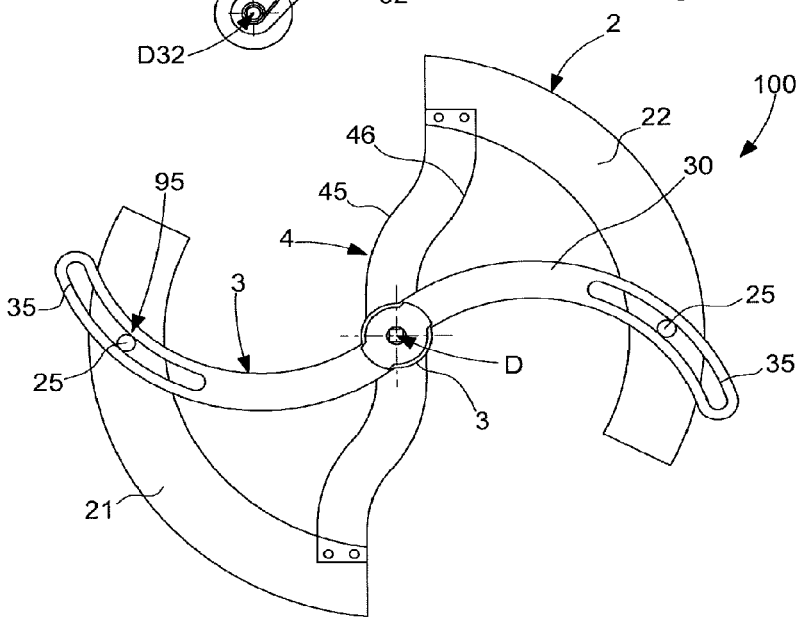
FIG. 13 is a schematic plan view of a further variant, in which the kinematic linkage comprises curvilinear guide means combining a curved groove of the central wheel train and a pin carried by the inertial element in question, and wherein the elastic restoring means have two elastic blades parallel to one another to limit the movement of each inertial element at a single degree of freedom.

FIG. 13 shows a further variant, in which the kinematic linkage has curvilinear guide means 95 combining a curved groove 35 of the central wheel train 30 and a pin 25 carried by the inertial element 21, 22 in question. In this variant, for the suspension and restoration of each inertial element 21, 22, the elastic restoring means 4 have two elastic blades 45 and 46 that are substantially parallel to one another in order to limit the movement of each inertial element 21, 22 at a single degree of freedom.

Figure 14:
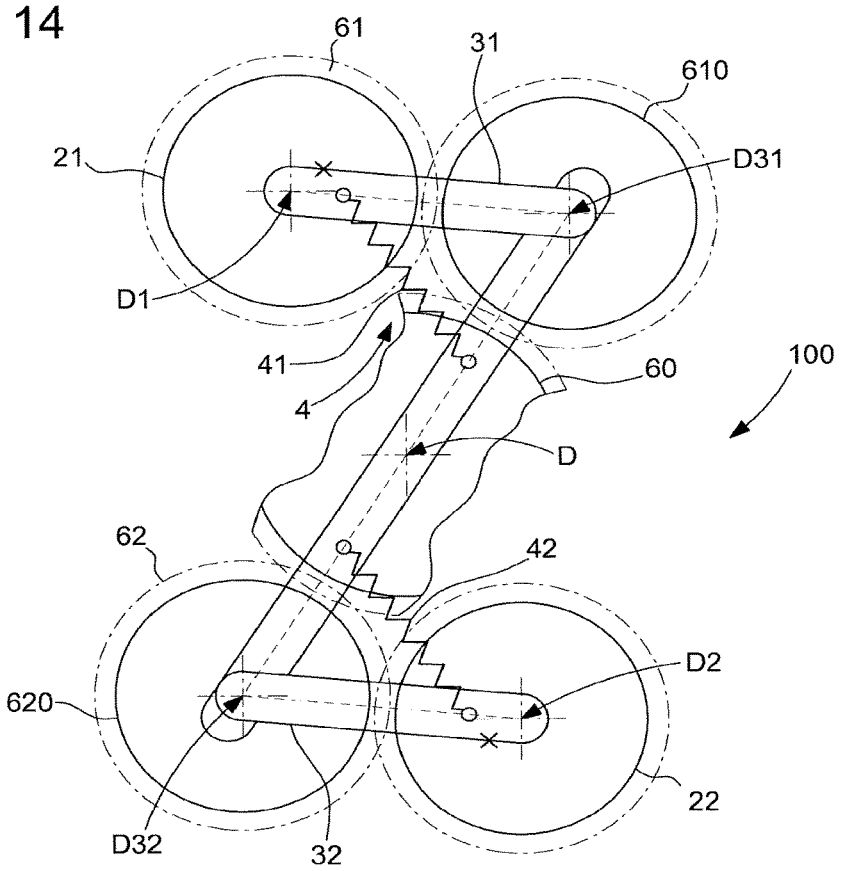
FIG. 14 is a schematic plan view of a structure close to that of FIG. 9 having an axial idle toothed wheel, which cooperates with two intermediate wheels, which themselves mesh with wheels integral to the inertial elements, and arms, which are articulated on the common structure by classic draw springs.

FIG. 14 shows a structure close to that of FIG. 9 having a toothed wheel 60 mounted loosely concentrically to the axis of rotation D and which cooperates continuously with two intermediate wheels 610 and 620, which themselves mesh with wheels or toothed sectors 61 and 62 integral to the inertial elements 21 and 22 and the arms 31 and 32. Here the latter are shown articulated to the common structure 3 by classic draw springs.

FIG. 15 shows a variant where the kinematic linkage is not rigid, but flexible, and the common structure 30 is a flexible blade that carries the inertial elements 21 and 22, which each bear a support arm of a rack element 161, 162, which cooperates with an axial idle wheel 60. In this very simple mechanism, however, the inertial elements 21 and 22 can move to two degrees of freedom.

Figure 16:
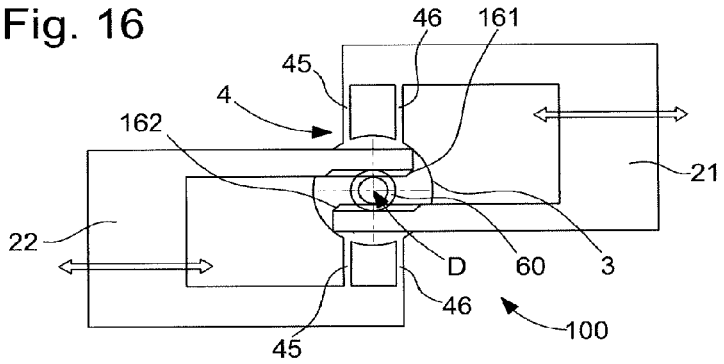
FIG. 16 is a schematic plan view of a variant of FIG. 15 having elastic restoring means, which for each inertial element have two parallel elastic blades to limit the movement of each inertial element at a single degree of freedom.

The configuration of FIG. 16 solves this problem by using, like in the configuration of FIG. 13, elastic restoring means 4 that, for the suspension and restoration of each inertial element 21, 22, have two elastic blades 45 and 46 that are substantially parallel to one another in order to limit the movement of each inertial element 21, 22 at a single degree of freedom.

In a particular configuration the complete resonator mechanism 100 (guide, inertial element, elastic restoring means, arms, wheel train) is in a single piece. The rotary resonator assembly can be made from silicon machined by multilevel DRIE, for example. When this execution is impractical, in particular when using crossed blades at different levels, an upper single-piece structure 101 and a lower single-piece structure 102, each simple to produce, can be advantageously superposed as in the case of FIG. 8A, and these can be assembled together very easily by gluing, riveting or other means. More specifically, the upper single-piece structure 101 and a lower single-piece structure 102 are assembled together irreversibly to create a single-piece component that cannot be dismantled.

In a particular variant the rotation frequency of the rotary resonator mechanism 100 is higher than 20 Hz and in particular higher than 50 Hz. This relatively high frequency enables the sensitivity to positions in the gravitation field to be limited in the case where there is no kinematic linkage.

It is understood that the invention devised for counting time is also usable for other mechanisms such as a striking mechanism regulator or other mechanism.

The elastic restoring means of the invention are installed in the rotary resonator, which enables its construction to be simplified.

Moreover, the kinematic linkage means of the invention reduce the number of degrees of freedom of the system by completely linking the displacement of the masses, whereas in the prior art the link is flexible and cannot reduce the number of degrees of freedom.

The invention also relates to a timepiece movement 200 comprising a support plate of means for accumulating and storing energy 210, in particular at least one barrel 211, arranged classically to drive a wheel train 220, in particular a going train, the element furthest downstream of which is arranged to drive the input wheel train 1 of such a rotary resonator mechanism 100 belonging to this movement 200.

The invention also relates to a timepiece, in particular a watch 300, having at least one timepiece movement 200 and/or such a rotary resonator mechanism 100.

This invention has different advantages, in particular:

- elimination of the traditional escapement mechanism allowing the mechanism to be simplified;
- elimination of the friction action of the pivots of a spring balance allowing the quality factor of the resonator mechanism to be increased;
- elimination of the jolts of the escapement allowing the efficiency to be increased;
- increasing the power reserve and/or the precision of current mechanical watches.

For a given movement size, it is possible to quintuple the autonomy of the watch and to double the power controlling the watch. This amounts to saying that the invention allows a factor 10 gain on performance rates of the movement.

What is claimed is:

1. A resonator mechanism for a timepiece movement having an input wheel train mounted to pivot around an axis of rotation and subjected to a driving torque, and having a central wheel train fixed in rotation to said input wheel train around said axis of rotation and arranged to turn continuously, wherein said resonator mechanism has a plurality of N inertial elements, each being movable in relation to said central wheel train, and restored to said axis of rotation by elastic restoring means belonging to said resonator mechanism, which are arranged to cause a restoring effort on the centre of mass of said inertial element, wherein said resonator mechanism has a rotational symmetry of order N, wherein said resonator mechanism has kinematic linkage means between all said inertial elements that are arranged to maintain at any time the centres of mass of said inertial elements at the same distance from said axis of rotation, and also wherein said elastic restoring means, which are rotational and borne by said resonator mechanism, cause an elastic potential wherein by the following equation:

$$V=\tfrac{1}{2}\cdot(d\alpha_0/dt)^2\cdot\Sigma(MjRj^2)$$

where:

V is the elastic potential

Σj is the sum of the quantity between parentheses $(d\alpha_0/dt)$ is the speed of rotation to be imposed Rj is the distance of the axis of rotation from the centre of mass G of said inertial element Mj is the mass of said inertial element.

2. The resonator mechanism according to claim 1, wherein said resonator mechanism has a pantograph structure articulated around said axis of rotation having at least all said inertial elements either directly articulated or indirectly articulated with arms, wherein the variants are given the references, around said central wheel train and a secondary central wheel train, which is arranged to pivot around said axis of rotation and wherein together with the central wheel train constitutes a crossed structure.

3. The resonator mechanism according to claim 2, wherein said crossed structure formed by said central wheel train and said secondary central wheel train has its centre of mass on said axis of rotation.

4. The resonator mechanism according to claim 2, wherein each member of said pantograph comprises four segments articulated to one another and in relation to a pivot axis formed by a main joint or said axis of rotation, wherein said central wheel train is formed from two first segments in the extension of one another in relation to said main joint, and said secondary central wheel train is formed from two second segments in the extension of one another in relation to said main joint, and wherein said elastic restoring means generate a potential energy V, which is dependent on the angle of deformation $\beta_1$ of said pantograph member in accordance with equation:

$$\partial V(\beta_1)/\partial\beta=\tfrac{1}{2}\cdot(d\alpha_0/dt)^2\cdot\Sigma j(Mj\cdot Rj(\beta_1)\cdot R'j(\beta_1)),$$

where:

$V(\beta_1)$ is the potential as a function of angle $\beta_1$, $\beta_1$ is the opening angle of the pantograph, i.e. the angle between, on the one hand, the straight line that joins the point of the pantograph opposite the pivot axis to the pivot axis and, on the other hand, the segment in question, $d\alpha_0/dt$ is the speed of rotation of said rotary resonator mechanism, Σj is the sum over the js of the quantity between parentheses, Mj is the mass of the inertial element of row j $Rj(\beta_1)$ is the distance of the axis of rotation to the centre of mass Gj of the inertial element, $R'j(\beta_1)$ is the derivative of the distance between the pivot axis and the centre of mass of the inertial element in relation to $\beta_1$.

5. The resonator mechanism according to claim 2, wherein said pantograph structure has a symmetry around said axis of rotation or having a symmetry of rotation of order around said axis of rotation.

6. The resonator mechanism according to claim 2, wherein all said inertial elements are articulated directly to said central wheel train and said secondary central wheel train.

7. The resonator mechanism according to claim 2, wherein the centre of mass of each of said arms, which is contained between two articulations, is located on a straight line joining the two articulations on either side of said arm in question.

8. The resonator mechanism according to claim 7, wherein each member of said pantograph comprises four segments of equal length and together form a regular rhombus, and wherein the potential energy $V_{tot}$ of said elastic restoring means is linked to their angle of deformation by the equation:

$$V_{tot}(\beta 1)=L(M_3\cdot R_3+M_4\cdot R_4)\cdot(d\alpha_0/dt)^2\cdot\cos 2\beta_1$$

where:

$\beta_1$ is the opening angle of the pantograph, which is the angle between the straight line that joins the point of the pantograph opposite the pivot axis to the pivot axis, on the one hand, and the segment in question, on the other hand, L is the length of each segment between the articulations, $M_3$ is the mass of a third segment forming one of the two inertial elements opposite the pivot axis formed by a main joint or by said axis of rotation and contained between a first lateral joint and an apex joint opposite an axis joint forming said main joint, $M_4$ is the mass of a fourth segment forming the other of the two inertial elements opposite said pivot axis and contained between a second lateral joint and said apex joint, $R_3$ is the distance of the first lateral joint from the centre of mass G3 of said third segment, $R_4$ is the distance of the second lateral joint from the centre of mass G4 of said fourth segment, $d\alpha_0/dt$ is the speed of rotation of the rotary resonator.

9. The resonator mechanism according to claim 2, wherein each member of said pantograph comprises four segments of equal length and together form a regular rhombus.

10. The resonator mechanism according to claim 2, wherein said central wheel train and said secondary central wheel train are each fixed to said input wheel train by an elastic connection.

11. The resonator mechanism according to claim 10, wherein said elastic connection is a flexible rotary guide arrangement having two elastic blades.

12. The resonator mechanism according to claim 2, wherein each said inertial element is guided directly or indirectly with arms or secondary articulated systems in relation to the pantograph structure by at least one guide means, and wherein at least one of the guide elements and at least one of said elastic restoring means are joined together by a flexible guide means.

13. The resonator mechanism according to claim 12, wherein except for guide arrangements at the level of said axis of rotation, all the guide arrangements in rotation and elastic restoring means belonging to said resonator mechanism are formed by flexible guide means.

14. The resonator mechanism according to claim 12, wherein at least one said flexible guide means has at least two elastic blades contained in planes that together define the virtual axis of rotation of a flexible rotary guide arrangement.

15. The resonator mechanism according to claim 14, wherein at least one said flexible rotary guide arrangement between two components is a guide arrangement with crossed blades projecting on a projection plane, the opening angle θ of which, read on the projection plane between the intersection axis C of the projections of said blades on said plane and the anchorage points of the blades on one of the components, has a value of 40°+/−4°, and the blades cross at a proportion of length of 0.15+/−0.015.

16. The resonator mechanism according to claim 12, wherein said flexible guide means are made from oxidised silicon to compensate thermal effects.

17. The resonator mechanism according to claim 2, wherein in said pantograph structure at least four of its articulations are formed by flexible rotary guide arrangements.

18. The resonator mechanism according to claim 1, wherein said kinematic linkage means between all said inertial elements have at least one idle wheel mounted loosely concentrically to said axis of rotation and which cooperates continuously with a toothed sector or a rack belonging to each said inertial element.

19. The resonator mechanism according to claim 1, wherein said kinematic linkage means have radial linear guide means with a radial guide bar sliding into bores belonging to said inertial elements.

20. The resonator mechanism according to claim 1, wherein said resonator mechanism is made of a single piece.

21. The resonator mechanism according to claim 1, wherein said resonator mechanism has flexible guide means with crossed blades in different levels and has, in superposed arrangement and fitted together, a single-piece upper structure, which comprises all the upper blades, and a single-piece lower structure, which comprises all the lower blades.

22. The resonator mechanism according to claim 1, wherein the rotation frequency of said rotary resonator mechanism is higher than 20 Hz.

23. A timepiece movement having a rotary resonator mechanism according to claim 1, and having a support plate of means for accumulating and storing energy or at least one barrel arranged to drive a wheel train arranged to drive the input wheel train of said rotary resonator mechanism.

24. A watch having at least one timepiece movement according to claim 23.

* * * * *